US006206510B1

(12) United States Patent
Casserino et al.

(10) Patent No.: US 6,206,510 B1
(45) Date of Patent: Mar. 27, 2001

(54) METHOD AND APPARATUS FOR ADAPTING AN INK JET PRINTING SYSTEM FOR RECEIVING AN ALTERNATE SUPPLY OF INK

(75) Inventors: Matthew J. Casserino, Lebanon; Dennis R. Nelson, SE Albany, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/298,509

(22) Filed: Apr. 22, 1999

(51) Int. Cl.[7] ..... B41J 2/17; B41J 2/16
(52) U.S. Cl. ..... 347/84; 347/49
(58) Field of Search ..... 347/84, 85, 86, 347/87, 49

(56) References Cited

U.S. PATENT DOCUMENTS

| | | | | |
|---|---|---|---|---|
| 3,950,761 | | 4/1976 | Kashio . | |
| 4,628,332 | | 12/1986 | Matsumoto . | |
| 5,245,365 | | 9/1993 | Woodard et al. . | |
| 5,515,091 | | 5/1996 | Kimura et al. | 347/86 |
| 5,699,091 | | 12/1997 | Bullock et al. | 347/19 |
| 5,721,576 | | 2/1998 | Barinaga . | |
| 5,788,388 | | 8/1998 | Cowger et al. | 400/703 |
| 5,852,459 | | 12/1998 | Pawlowski, Jr. et al. . | |
| 5,966,155 | * | 10/1999 | Pawlowski, Jr. et al. | 347/85 |
| 6,024,441 | * | 2/2000 | Nishimoto | 347/85 |

FOREIGN PATENT DOCUMENTS

| | | | | |
|---|---|---|---|---|
| 0 655 336 A1 | | 5/1995 | (EP) | B41J/2/175 |
| 0 940 260 A1 | | 3/1999 | (EP) | B41J/2/175 |
| 7-246713 | * | 9/1995 | (JP) . | |

* cited by examiner

*Primary Examiner*—N. Le
*Assistant Examiner*—Judy Nguyen
(74) *Attorney, Agent, or Firm*—Kevin B. Sullivan

(57) ABSTRACT

One aspect of the present invention is a method for adapting an ink jet printing system for receiving an alternate supply of ink. The ink jet printing system has an ink jet printhead responsive to control signals for selectively depositing ink on media. Also included in the printing system is a docking station configured for receiving a replaceable ink container. The replaceable ink container includes a fluid outlet that is arranged to establish fluid communication with a fluid inlet associated with the docking station upon insertion of the replaceable ink container into the docking station. The replaceable ink container provides a supply of ink from the replaceable ink container to the ink jet printhead. The method includes disconnecting. a fluid conduit extending between the fluid inlet and the ink jet printhead thereby interrupting the supply of ink from the replaceable ink container to the ink jet printhead. The method further includes connecting an alternate fluid conduit between the fluid inlet and the ink jet printhead. The alternate fluid conduit is in fluid communication with an alternate ink reservoir, wherein alternate ink is delivered from the alternate ink reservoir to the ink jet printhead.

7 Claims, 6 Drawing Sheets

METHOD AND APPARATUS FOR ADAPTING AN INK JET PRINTING SYSTEM FOR RECEIVING AN ALTERNATE SUPPLY OF INK

BACKGROUND OF THE INVENTION

The present invention relates to ink jet printing and, more particularly, to ink jet printing systems having replaceable ink containers for supplying ink to a printhead. A typical ink-jet printer has a printhead mounted to a carriage that is moved back and forth over print media such as paper. As the printhead passes over appropriate locations on the printing surface, a control system activates the printhead to eject, or jet, ink drops onto the printing surface and form desired images and characters.

To work properly, such printers must have a reliable supply of ink for the printhead. Many ink-jet printers use a disposable print cartridge that can be mounted to the carriage. Such a print cartridge typically includes, in addition to the printhead, a reservoir containing a supply of ink. The print cartridge also typically includes pressure-regulating mechanisms to maintain the ink supply at an appropriate pressure for use by the printhead. When the ink supply is exhausted, the print cartridge is disposed of and a new print cartridge is installed. This system provides an easy, user-friendly way of providing an ink supply for an ink-jet printer.

Other types of ink-jet printers use ink supplies that are separate from the printhead and are not mounted to the carriage. Such ink supplies, because they are stationary within the printer, are not subject to the size limitations of an ink supply that moves with the carriage. Some printers with stationary ink supplies have a refillable ink reservoir built into the printer. Ink is supplied from the reservoir to the printhead through a tube that trails from the printhead. Alternatively, the printhead can include a small ink reservoir that is periodically replenished by moving the printhead to a filling station at the stationary, built-in reservoir. In either alternative, ink may be supplied from the reservoir to the printhead by either a pump within the printer or by gravity flow.

SUMMARY OF THE INVENTION

One aspect of the present invention is a method for adapting an ink jet printing system for receiving an alternate supply of ink. The ink jet printing system has an ink jet printhead responsive to control signals for selectively depositing ink on media. Also included in the printing system is a docking station configured for receiving a replaceable ink container. The replaceable ink container includes a fluid outlet that is arranged to establish fluid communication with a fluid inlet associated with the docking station upon insertion of the replaceable ink container into the docking station. The replaceable ink container provides a supply of ink from the replaceable ink container to the ink jet printhead. The method includes disconnecting a fluid conduit extending between the fluid inlet and the ink jet printhead, thereby interrupting the supply of ink from the replaceable ink container to the ink jet printhead. The method further includes connecting an alternate fluid conduit between the fluid inlet and the ink jet printhead. The alternate fluid conduit is in fluid communication with an alternate ink reservoir, wherein alternate ink is delivered from the alternate ink reservoir to the ink jet printhead.

DETAILED DESCRIPTION OF THE PREFERRED EMBODIMENT

Before discussing the technique of the present invention for adapting an ink jet printing system for receiving an alternative supply of ink, it will be helpful to first discuss the detail of an exemplary printing system. The exemplary printing system will first be discussed with respect to FIGS. 1–3. The technique for adapting this exemplary printing system will then be discussed with respect to FIGS. 4–6.

Figure 1:
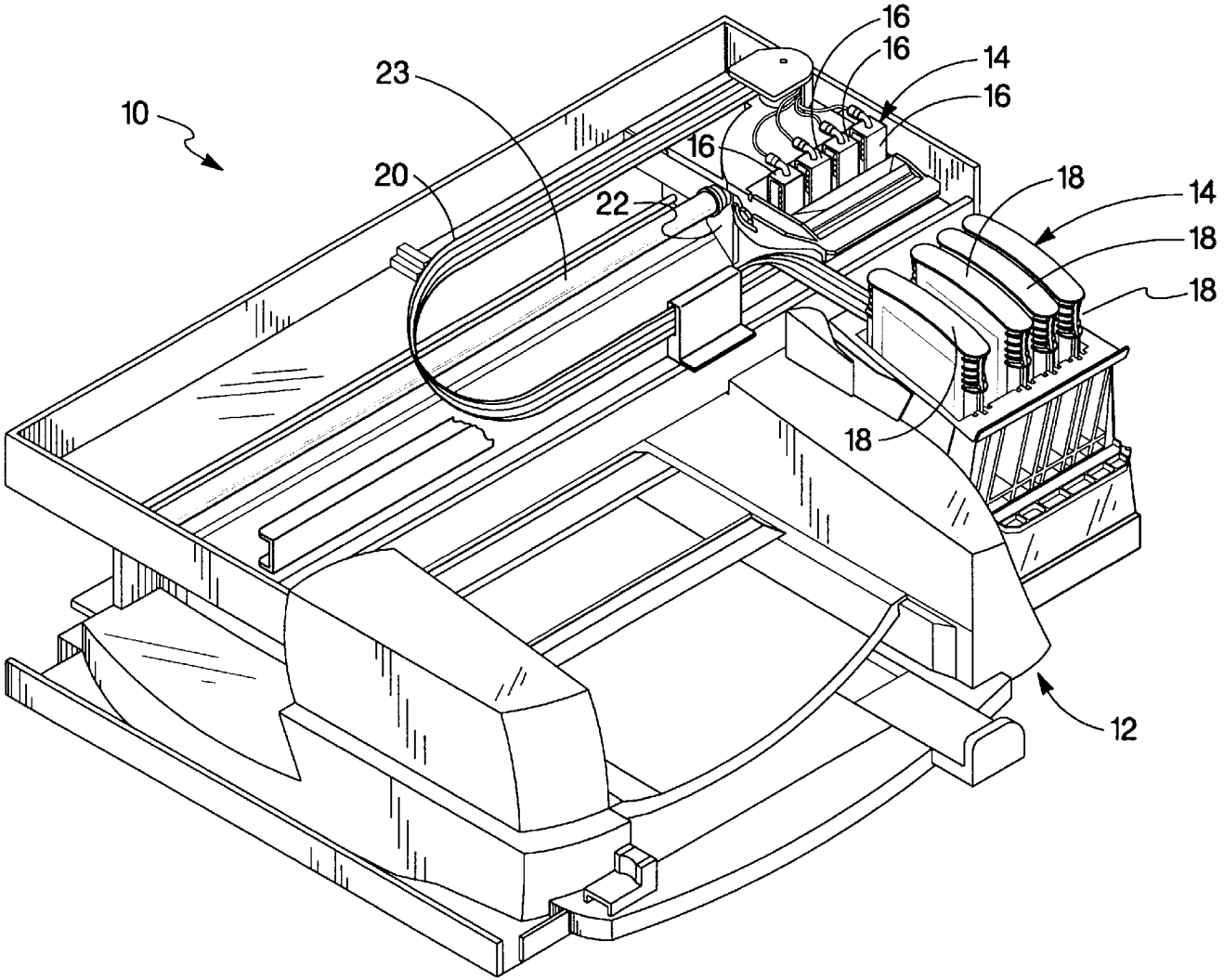
FIG. 1 depicts a representation of an ink jet printing system for which the technique of the present invention is used for adapting the ink jet printing system for receiving an alternate supply of ink.

FIG. 1 depicts an exemplary embodiment of an inkjet printing system 10, shown with its cover removed. The inkjet printing system 10 includes a printer portion 12 having a plurality of replaceable printing components 14 installed therein. The plurality of replaceable printing components 14 includes a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers by a plurality of flexible conduits 20.

Each of the plurality of printheads 16 is mounted in a scanning carriage 22 and the scanning carriage 22 is moved on a carriage support rod 23 as print media (not shown) is stepped through a print zone. As the plurality of printheads 16 are moved relative to the print media, ink is selectively ejected from a plurality of orifices in each of the plurality of printheads 16 to form images and text.

Figure 2:
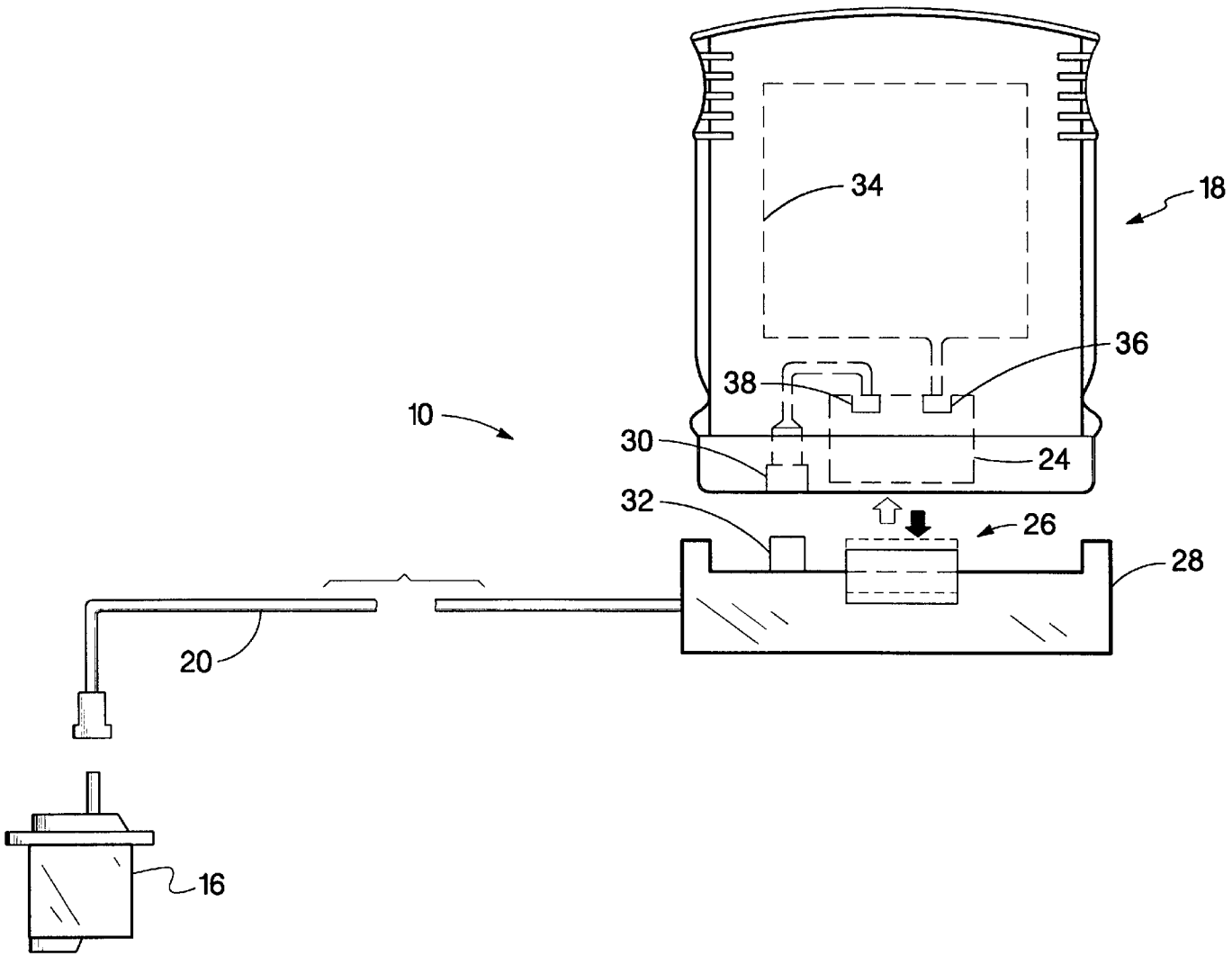
FIG. 2 depicts a simplified schematic representation of the printing system of FIG. 1.

FIG. 2 depicts a simplified schematic representation of the inkjet printing system 10 of FIG. 1. The inkjet printing system 10 includes ink container 18 that includes a diaphragm pump 24 for providing a pressurized source of ink to the printhead 16. An actuator 26 that is associated with a docking station or supply station 28 actuates the diaphragm pump 24.

With the ink container 18 properly installed into the supply station 28, a fluid outlet 30 associated with the ink container 18 fluidically couples with a fluid inlet 32 associated with the supply station 28. The fluid inlet 32 is fluidically coupled to the printhead by the conduit 20.

The diaphragm pump 24 is coupled to an ink reservoir 34 within the ink container by a fluid inlet 36 that selectively allows ink to flow into the diaphragm pump 24. A fluid outlet 38 allows ink to exit the diaphragm pump 24. An ink conduit connects the fluid outlet 38 with the fluid outlet 30 associated with the ink container 18. As the actuator 26 engages the diaphragm pump 24 ink is pressurized within the diaphragm pump 24. This pressurized ink within the diaphragm pump is forced out of fluid outlet 38 to provide a source of pressurized fluid at fluid outlet 30 of the ink container 18. In this manner, the diaphragm pump 24 and actuator 26 ensure a constant supply of pressurized ink to the printhead 16.

During printing, pressurized ink flows from the ink container 18 to the printhead 16 whereupon ink is selectively ejected onto print media. The printhead 16 includes an accumulator mechanism that maintains a constant negative pressure within the printhead 16. Air which accumulates in the printhead 16 tends to expand under various environmental and temperature conditions during both printing and nonprinting conditions. The accumulator (not shown) compensates for the expansion and contraction of air to maintain a constant negative pressure within the printhead 16. This negative pressure is necessary to ensure proper printhead operation as well as to prevent leakage of ink (sometimes referred to as drooling) from the printhead nozzles.

Figure 3:
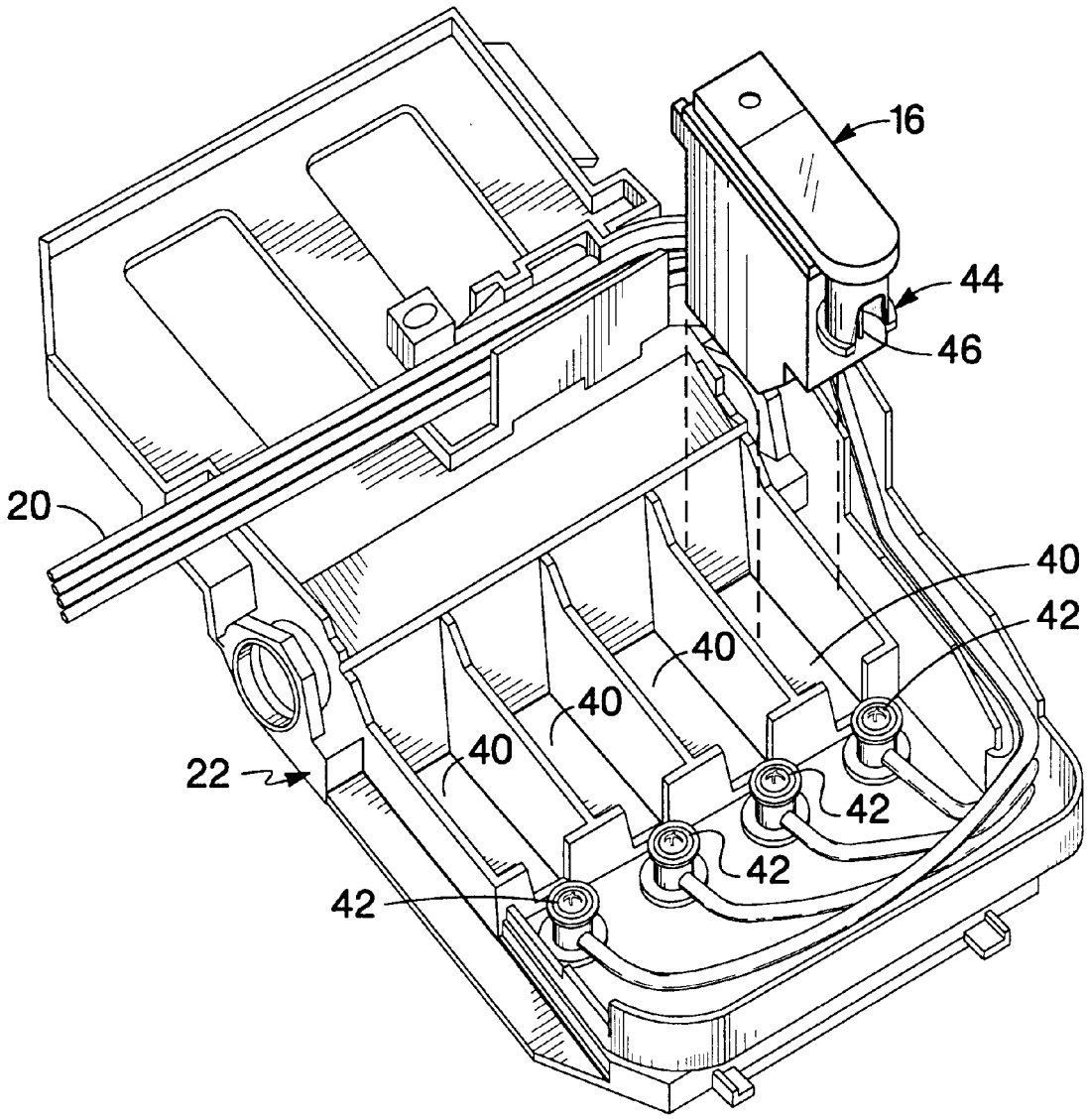
FIG. 3 depicts a printhead positioned for insertion into a scanning carriage for the ink jet printing system shown in FIG. 1.

FIG. 3 depicts the scanning carriage 22 from the ink jet printing system 10 of FIG. 1 shown greatly enlarged and in isolation. The scanning carriage 22 includes a plurality of printhead receiving bays 40 for receiving each of a plurality of ink jet printheads 16. One of the plurality of ink jet printheads 16 is shown positioned for insertion into one of the plurality of ink jet receiving bays 40. Associated with each of the printhead receiving bays 40 is a fluid coupling 42. Each of the plurality of fluid couplings 42 are connected to each of a plurality of ink containers 18 (shown in FIG. 1) by each of a plurality of fluid conduits 20.

Each of the plurality of ink jet printheads 16 include a fluid inlet portion 44 for receiving a supply of ink. In one preferred embodiment, the fluid inlet 44 includes a hollow needle portion 46 having distal and proximal ends. The proximal end of the hollow needle 46 is in fluid communication with a fluid reservoir within the printhead 16. The distal end of the hollow needle 46 has an aperture therein for allowing ink to flow into the hollow needle 46.

In one preferred embodiment, the fluid interconnect 42 includes a preslit septum having a spring-biased sealing ball therein. The septum is formed from a compliant material to seal the preslit portion to prevent ink leakage.

The fluid interconnect 44 associated with the printhead 16 is configured to engage and establish fluid communication between the printhead 16 and the fluid interconnect 42 as the printhead 16 is properly inserted into the printhead receiving bay 40 of carriage 22. Insertion of the printhead 16 into the carriage 22 aligns the needle 46 with the preslit septum of the fluid interconnect 42 and dislodges a sealing ball to allow fluid communication between the printhead 16 and the corresponding ink container 18 connected to the fluid conduit 20.

The present invention is directed to a technique for adapting the ink jet printing system 10 to receive ink from an alternate supply of ink. An initial source of ink for the printhead 16 is the pressurized supply of ink provided by the ink container 18. However, an alternate supply of ink may be desirable for various reasons such as for utilizing special inks or printing fluid for special applications. These applications include printing on special media, or using nonstandard inks, to name two. In addition, an alternate supply of ink may be needed for testing operation of the printhead or ink delivery system. The technique of the present invention allows alternate ink to be supplied to the printhead 16 instead of the initial ink provided by the ink container 18. The alternate ink is provided to the printhead 16 by means of an alternate supply of ink that will be discussed with respect FIGS. 4–6.

Figure 4:
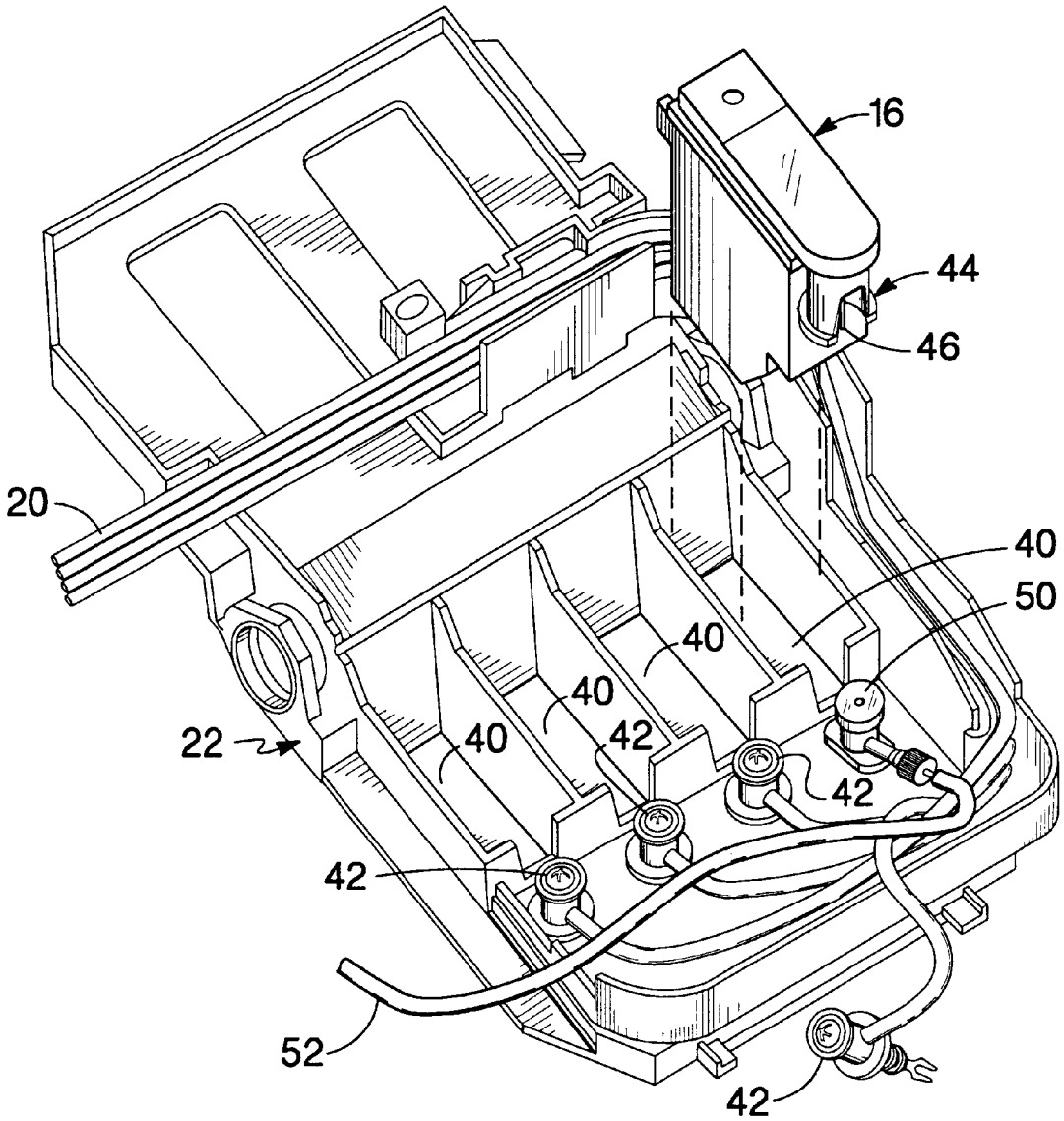
FIG. 4 depicts one example of the technique of the present invention for adapting the scanning carriage to receive an alternate supply of ink.

FIG. 4 depicts a scanning carriage 22 shown in FIG. 3, adapted using the technique of the present invention for providing an alternate source of ink to the ink jet printhead 16. The technique of the present invention includes disconnecting the pressurized supply of ink provided by the ink container 18. In one preferred embodiment, the pressurized supply of ink is disconnected by disconnecting a fluid path between the fluid inlet 32 associated with the ink container docking station 28 and the ink jet printhead 16. An alternative fluid conduit is then connected between the fluid inlet 32 and the ink jet printhead 16. This alternate fluid conduit is connected to an alternate ink reservoir for providing an alternate source of ink to the ink jet printhead 16.

In one preferred embodiment, the fluid interconnect 42 is unseated from the scanning carriage 22 and displaced from a location proximate the printhead receiving bay 40. A replacement fluid interconnect 50 is positioned in place of the fluid interconnect 42 proximate the printhead receiving bay 40. The replacement fluid interconnect 50 is configured to receive the hollow needle 46 associated with the fluid interconnect 44 as the printhead 16 is positioned properly in the printhead receiving bay 40. An alternate conduit 52 provides an alternate supply of ink to the printhead 16 once fluid communication is established between the fluid interconnects 44 and 50.

In a similar manner, a plurality of alternate fluid interconnects 50 can be used to replace each of the plurality of fluid interconnects 42 for providing an alternate supply of ink for each of the plurality of printheads 16. In this case four separate alternate fluid supply conduits 52 are provided with each of the fluid supply conduits 52 connected to each of the plurality of alternate fluid interconnects 50. This arrangement allows alternate ink to be provided to each of the printheads 16.

In a preferred embodiment, as indicated by FIG. 4, each printhead 16 is configured to be inserted into the printhead receiving bay 40 in a substantially linear motion. As a result of this insertion, fluid outlet 46 automatically couples to alternate fluid interconnect 50 in much the same way that a printhead 16 would couple to the fluid interconnect 42.

Figure 5:
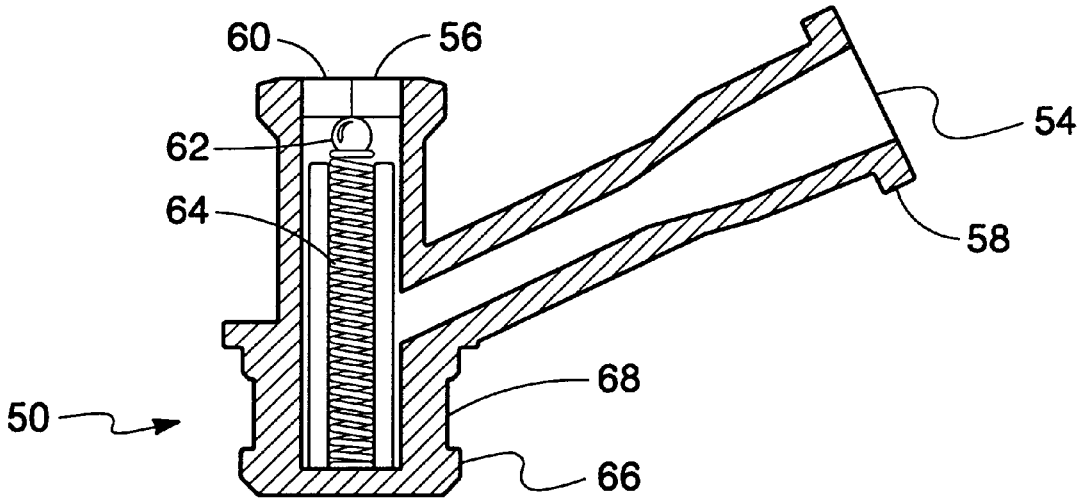
FIG. 5 depicts a preferred fluid interconnect for use in the technique for adapting the scanning carriage of FIG. 4.

FIG. 5 depicts greater detail of the alternate fluid interconnect 50 shown in FIG. 4. The alternate fluid interconnect 50 includes a fluid inlet portion 54 and a fluid outlet portion 56. The fluid inlet portion 54 includes an interconnect portion 58 configured for connection to the alternate supply conduit 52. In one preferred embodiment, the connection portion 58 is a quarter turn luer fitting. The fluid outlet portion 56 includes a valve or sealing portion for preventing ink leakage when the printhead 16 is removed from the scanning carriage, thereby disconnecting the fluid interconnect 44 from the alternate fluid interconnect 50. In one preferred embodiment, the sealing portion includes a compliant septum 60 having a preformed slit therein and a sealing ball 62 that is biased by spring 64 against the compliant sealing member 60 to prevent ink from leaking therefrom. With the printhead 16 properly inserted into the printhead receiving bay 40, the hollow needle 46 pierces the compliant septum 60 and displaces the sealing ball 62 to allow fluid to pass from the fluid inlet 54 into the hollow needle 46 and then into the printhead 16.

The fluid interconnect 50 includes a base portion 66 that is configured for mounting to the scanning carriage 22. The base portion 66 includes a flange 68 which allows the fluid interconnect 50 to be press-fit into an aperture formed in the scanning carriage 22.

Figure 6:
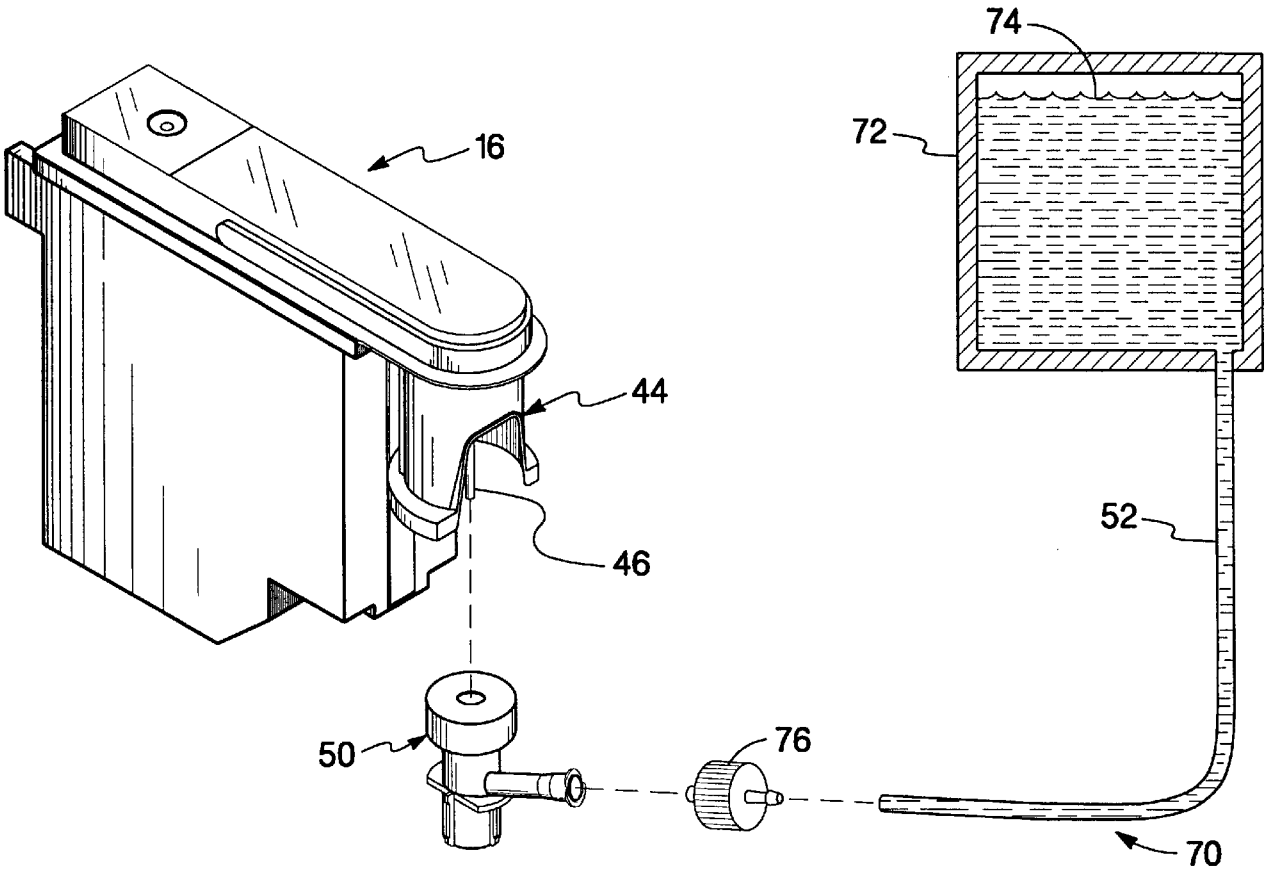
FIG. 6 depicts a schematic representation of an alternative supply of ink for providing ink to the ink jet printhead.

FIG. 6 depicts a schematic representation of an alternate supply system 70 for providing ink to the ink jet printhead 16. The alternate ink supply system 70 includes an alternate ink container 72 having an alternate supply of ink 74 contained therein. The alternate fluid conduit 52 is in fluid communication with the alternate reservoir 72 to allow the alternate supply of ink 74 to flow therethrough. Attached to the alternate fluid conduit 52 opposite the ink reservoir 72 is a fluid coupling 76 such as a quarter turn luer fitting for connecting the alternate fluid conduit 52 with the alternate fluid interconnect 50. The fluid coupling includes a press-fit fluidic seal for insertion into the alternate fluid conduit 52 and a quarter turn luer fitting for quick attachment to the fluid interconnect 50. With the alternate fluid interconnect 50 mounted in the scanning carriage 22, the ink jet printhead forms a fluid interconnect between the printhead and the alternate fluid interconnect 50. Once the printhead 16 is properly inserted into the scanning carriage, the alternate ink 74 is provided by the alternate fluid delivery system 70 to the printhead 16.

The alternate supply system 70 shown in FIG. 6 is preferably a non-pressurized ink supply system. The alternate supply of ink 74 is delivered to the printhead 16 by a negative pressure referred to as backpressure within the printhead 16 that draws the alternate supply of ink 74 to the printhead 16. In addition, an ink head due to gravity acting on the alternate ink 74 tends to force ink from the alternate reservoir 72 to the printhead. Alternatively, the alternate supply system 70 can be pressurized to provide a pressurized source of alternate ink 74 to the printhead 16.

The present invention provides a technique for adapting an ink jet printing system 10 for receiving an alternate supply of ink. This technique allows the ink jet printing system to be adapted easily and allows the use of a low cost alternate ink delivery system 70. In addition, the alternate ink delivery system of the present invention allows for the replacement of the ink reservoir in a quick and easy manner once the reservoir is depleted of ink.

What is claimed is:

1. A method for adapting an ink jet printing system for receiving ink from an alternative non-pressurized supply of ink, the ink jet printing system including a scanning carriage, an ink jet printhead responsive to control signals for selectively depositing ink on media and a pressurized ink delivery system including an ink supply responsive to actuation by an actuator for providing a pressurized supply of ink to a fluid interconnect of the scanning carriage, wherein the ink jet printhead is removably engaged with the scanning carriage such that a fluid inlet portion of the ink jet printhead is removably connected to the fluid interconnect, and wherein the fluid interconnect is removably mounted on the scanning carriage and configured to fluidically couple with the fluid inlet portion of the ink jet printhead upon insertion of the printhead into the scanning carriage, the method comprising:

disconnecting the fluid inlet portion of the ink jet printhead from the fluid interconnect of the pressurized ink delivery system;

dismounting the fluid interconnect from the scanning carriage;

providing an alternative non-pressurized supply of ink that is not adapted for actuation by the actuator, the alternative non-pressurized supply of ink having a replacement fluid interconnect; and mounting the replacement fluid interconnect onto the scanning carriage, the replacement fluid interconnect so disposed and arranged on the scanning carriage to fluidically couple with the fluid inlet portion of the ink jet printhead upon insertion of the printhead into the scanning carriage; and connecting the fluid inlet portion of the ink jet printhead directly to the replacement fluid interconnect of the alternative non-pressurized supply of ink to provide alternative non-pressurized ink, different from the pressurized supply of ink, to the ink jet printhead.

2. The method for adapting an ink jet printing system of claim 1 wherein upon disconnecting the fluid inlet portion of the ink jet printhead from the fluid interconnect of the pressurized ink delivery system the fluid interconnect is occluded to prevent ink leakage therefrom.

3. The method for adapting an inkjet printing system of claim 1 wherein mounting the replacement fluid interconnect onto the scanning carriage includes:

mounting the replacement fluid interconnect onto the scanning carriage in a same location as the fluid interconnect dismounted from the scanning carriage.

4. A method for adapting an ink jet printing system for receiving an alternate supply of ink, the ink jet printing system having a scanning carriage, an ink jet printhead responsive to control signals for selectively depositing ink on media and a docking station configured for receiving a replaceable ink container, the replaceable ink container including a fluid outlet that is arranged to establish fluid communication with a fluid inlet associated with the docking station upon insertion of the replaceable ink container into the docking station for providing a supply of ink from the replaceable ink container to the ink jet printhead, the fluid inlet including a fluid conduit having a fluid interconnect removably mounted to the scanning carriage, wherein the ink jet printhead is removably engaged with the scanning carriage such that a fluid inlet portion of the ink jet printhead is removably connected to the fluid interconnect, the method comprising:

disconnecting the fluid inlet portion of the ink jet printhead from the fluid interconnect of the fluid conduit so as to interrupt the supply of ink from the replaceable ink container to the ink jet printhead;

dismounting the fluid interconnect from the scanning carriage;

providing an alternate ink reservoir having an alternate fluid conduit including a replacement fluid interconnect;

mounting the replacement fluid interconnect onto the scanning carriage; and connecting the fluid inlet portion of the ink jet printhead directly to the replacement fluid interconnect of the alternate fluid conduit such that alternate ink is delivered from the alternate ink reservoir to the ink jet printhead.

5. The method for adapting an ink jet printing system of claim 4 wherein upon disconnecting the fluid inlet portion of the ink jet printhead from the fluid interconnect of the fluid conduit the fluid interconnect is occluded to prevent ink leakage therefrom.

6. The method for adapting an ink jet printing system of claim 4 wherein disconnecting the fluid inlet portion of the ink jet printhead from the fluid interconnect of the fluid conduit includes:

disengaging the ink jet printhead from the scanning carriage so as to disconnect the fluid inlet portion from the fluid interconnect.

7. The method for adapting an ink jet printing system of claim 4 wherein connecting the fluid inlet portion of the ink jet printhead to the replacement fluid interconnect of the alternate fluid conduit includes:

engaging the ink jet printhead with the scanning carriage, the replacement fluid interconnect so disposed and arranged on the scanning carriage to fluidically couple with the fluid inlet portion of the ink jet printhead upon insertion of the printhead into the scanning carriage.

* * * * *